US005570985A

United States Patent [19]

Latvakangas et al.

[11] Patent Number: 5,570,985

[45] Date of Patent: Nov. 5, 1996

[54] METHOD AND A DEVICE FOR THE MANUFACTURE OF BOOKLETS

[76] Inventors: Urpo Latvakangas, Allevagen 8, S-132 42 Saltsjo-Boo; Jan Sabelstrom, Taggsvampsvagen 173, S-141 46 Huddinge, both of Sweden

[21] Appl. No.: 224,809

[22] Filed: Apr. 8, 1994

[30] Foreign Application Priority Data

May 18, 1993 [SE] Sweden ..... 9301708

[51] Int. Cl.[6] ..... B42C 1/100; B65H 1/00

[52] U.S. Cl. ..... 412/4; 412/8; 412/9; 412/19; 412/20; 412/24; 412/902

[58] Field of Search ..... 412/8, 9, 18–22, 412/33, 37, 900, 902, 23, 24, 4

[56] References Cited

U.S. PATENT DOCUMENTS

| | | | |
|---|---|---|---|
| 936,480 | 10/1909 | Sague . | |
| 2,549,890 | 4/1951 | Burls | 412/21 |
| 3,093,396 | 6/1963 | Segreto | 412/16 |
| 3,743,276 | 7/1973 | Van der Does | 271/24 |
| 3,952,356 | 4/1976 | Giulie et al. | 412/9 |
| 3,992,741 | 11/1976 | Staats | 412/20 |
| 3,994,427 | 11/1976 | Ganatsiou | 227/100 |
| 4,178,201 | 12/1979 | Power et al. | 412/20 X |
| 4,367,116 | 1/1983 | Wilholm | 412/8 X |
| 4,371,155 | 2/1983 | Astero et al. | 412/37 X |
| 4,381,108 | 4/1983 | Newsome | 271/198 |
| 4,588,180 | 5/1986 | Ballestrazzi et al. | 271/5 |
| 4,626,156 | 12/1986 | Baughman et al. . | |
| 4,674,732 | 6/1987 | Hori | 270/53 |
| 4,764,073 | 8/1988 | Garlichs et al. | 412/9 |
| 4,855,010 | 8/1989 | Bolin et al. | 156/497 |
| 5,102,277 | 4/1992 | Tholerus . | |

FOREIGN PATENT DOCUMENTS

| | | | |
|---|---|---|---|
| 2118742 | 11/1971 | Germany . | |
| 513729 | 11/1971 | Switzerland . | |
| 1258746 | 12/1971 | United Kingdom . | |
| 9426535 | 11/1994 | WIPO | 412/4 |

*Primary Examiner*—Frances Han

[57] ABSTRACT

A method and apparatus are provided for manufacturing booklets. Each booklet is made of a cover having two cover sheets and a spine, a bead of glue attached to the inside of the spine, and a sheaf of papers inserted between the cover sheets and attached to the spine by the bead of glue. The apparatus and method include moving the sheaf of papers to a first position by a first transporter, moving one of several covers stored in a cassette to a second position by a second transporter, and moving the sheaf of papers and cover into contact so that the sheaf of papers is enclosed by the covers and a side edge of the sheaf contacts the bead of glue. The assembled booklet moves past a device for activating the bead of glue. A method is provided for filling the cassette, which stores and dispenses the covers, and a method and apparatus are provided for jogging up the sheaf of papers.

36 Claims, 3 Drawing Sheets

METHOD AND A DEVICE FOR THE MANUFACTURE OF BOOKLETS

TECHNICAL FIELD

The present invention relates to a method and a device for the manufacture of booklets. More specifically, the invention refers to booklets comprising a cover made up of two cover sheets, a spine therebetween, and a bead of glue attached to the inside of the spine, as well as a sheaf of papers inserted between the two cover sheets, one side edge of the sheaf being connected with the inside of the spine by means of the bead of glue.

BACKGROUND ART

Booklets of the kind described above are usually manufactured in the following way:

A flat sheet of cardboard and/or plastic is folded such that it is divided into two cover sheets and a spine forming a cover. A bead of melt glue is attached to the inside of the spine. This is done by melting the bead and then letting it solidify on cooling whereby it will adhere to the spine. The cover sheets are then folded towards each other such as to form a cover, the bead of glue being oriented between the cover sheets. When the finished covers have been packed and distributed, the user will take a cover out of the package and insert a sheaf of papers in the cover such that the side edge of said sheaf will bear against the bead of glue. He will then insert the cover containing the sheaf of papers into a binding machine, for example, of the kind disclosed in SE-B 434 367, such that the outside of the spine will get into contact with a heating plate. After a certain amount of time the glue will melt and the sheaf of papers will sink into it. The user will then remove the cover containing the sheaf of papers from the machine and the glue will be allowed to cool, the side edges of the sheaf of papers adhering to the spine.

The above described procedure is complicated and time-consuming, especially when a large number of booklets of the same or similar kind are to be manufactured.

From U.S. Pat. No. 5,102,277 there is previously known a method and a machine for binding sheaves of papers into covers of the above described kind. While said method and said machine represent developments of the manual binding by means of binding devices according to SE-B 434 367, they do not permit sheaves of papers fed out from, for example, a copying machine to be brought together with empty covers inserted in the machine.

From U.S. Pat. No. 2,549,890 there is previously known a machine for the manufacture of books. Book blocks are provided with glue on their lateral surfaces and are inserted into covers which, one at a time, will fall from a magazine in the machine. Thus, said machine provides products of a different kind from booklets, each of which consists of a cover connected with a sheaf of papers only at the spine. Further, said machine does not have any activation device for activating a bead of glue so as to connect the sheaf of papers to the spine.

From GB-A 1 258 746 there is known a book binding machine for the manufacture of book blocks by applying a melt glue along one edge of the book block. Thus, said machine provides products of a different kind from booklets containing sheaves of papers which are attached to the spines of the booklets. Further, it does not possess any transport means for moving sheaves of papers or booklets.

From U.S. Pat. No. 3,093,396 there is known a book binding machine wherein sheets of paper are interconnected along one of their side edges by means of several adhesive layers so as to form a book block. Each book block is then brought together with a cover lacking adhesive, and the adhesive layers on the book block are then activated via the backbone of the cover to be connected to the same. Thus, the machine provides products of a different kind from booklets consisting of covers with beads of glue provided on their spines, which covers are connected with sheaves of papers, the sheets of paper of which are not interconnected before binding. Further, in the known machine the covers are not brought together in a cassette or the like from which they are conveyed to the book blocks.

SUMMARY OF THE INVENTION

It is an object of the present invention to improve the known methods and devices and to provide a method and a device which will reduce the amount of manual handling, increase the manufacturing speed and improve the quality of the finished booklets.

This object is achieved by the invention presenting the features disclosed in the characterizing portions of the claims.

PREFERRED EMBODIMENT

Figure 1:
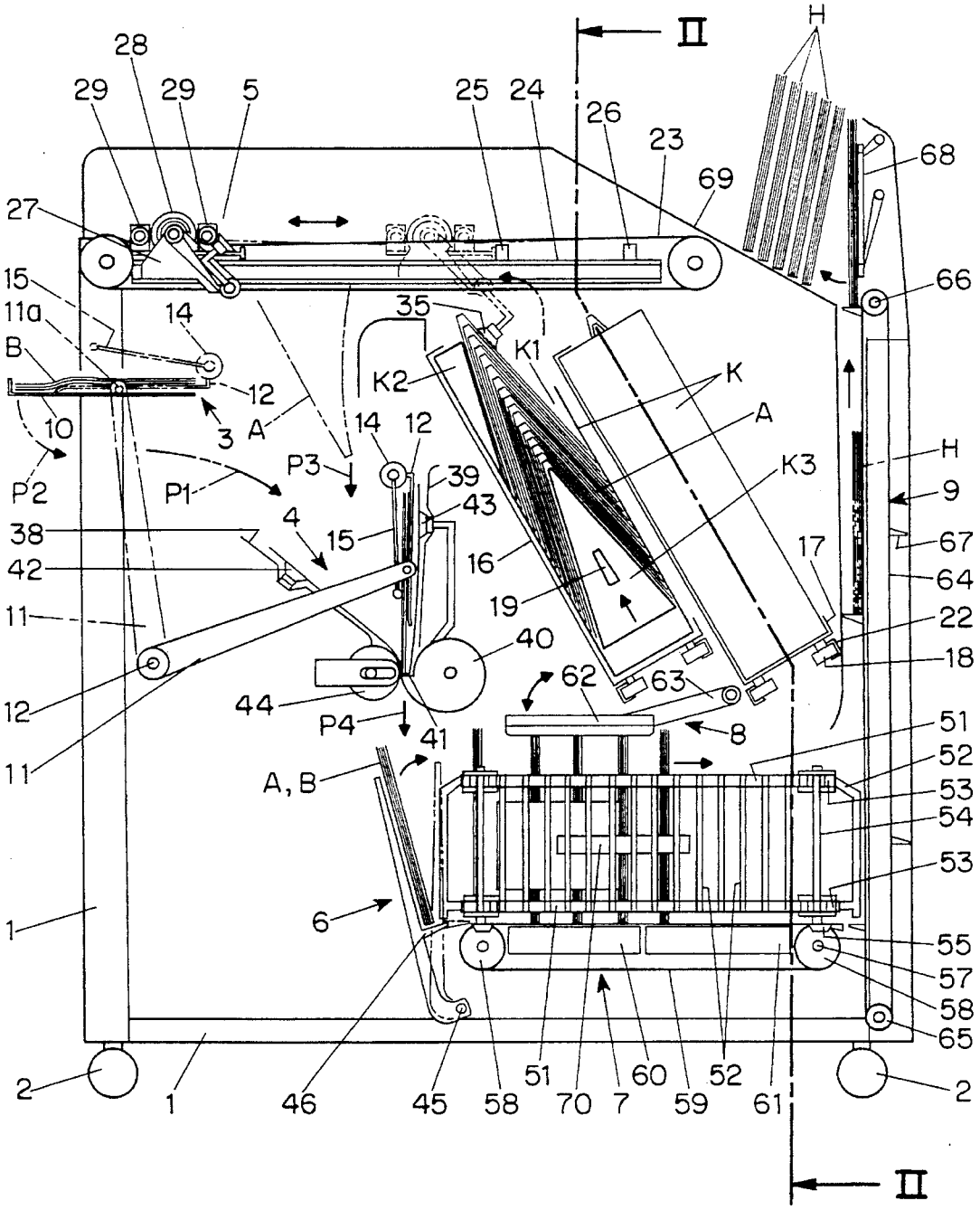
FIG. 1 is a schematic side view of the device according to the present invention.

The device according to the invention is built into a machine provided with a support 1 having wheels 2. The main parts of the machine are a device in the form of a platform 10, receiving a sheaf of papers B, the sheets of paper of which are not interconnected, from a copying machine (not shown) or a (laser)printer, a device 3, transporting the sheaf of papers to an assembly device 4, a device 5 for taking covers A out of a cassette K and transporting one cover at a time to the device 4, a device 6 for collecting covers containing sheaves of papers, which covers have been fed out from the assembly device 4, a device 7 for activation of a binding agent on the spine of each cover A, so as to connect the sheaf of papers in the cover with the spine thereof, a device 8 for jogging up the sheaves of papers in the covers in connection with their passing through the activation device 7, and a device 9 for carrying away booklets H comprising sheaves of papers B bound into the covers A.

The transport device 3 for the sheaves of papers B includes a plate 12 which is insertable between the platform 10 and a sheaf of papers B resting thereon, the plate being mounted at 11*a* on an arm 11 mounted at 12 to which arm a reciprocating pivoting movement is imparted by a driving device (not shown). Said pivoting movement in one direction (clockwise) is indicated by the arrow P1. A reciprocating pivoting movement is imparted also to the plate 12 on the arm 11 by a driving device (not shown). Said pivoting movement in one direction (counter-clockwise) is indicated by the arrow P2. On the plate 12 there is mounted, at 14, a holding means 15 to which is imparted, by a driving device (not shown), a pivoting movement between a position in which the holding means presses a sheaf of papers B lying on the plate 12 onto the same, as shown in solid lines in FIG. 1, and a position in which the holding means is at a distance from the sheaf of papers, as shown in dash dotted lines in FIG. 1.

Figure 2:
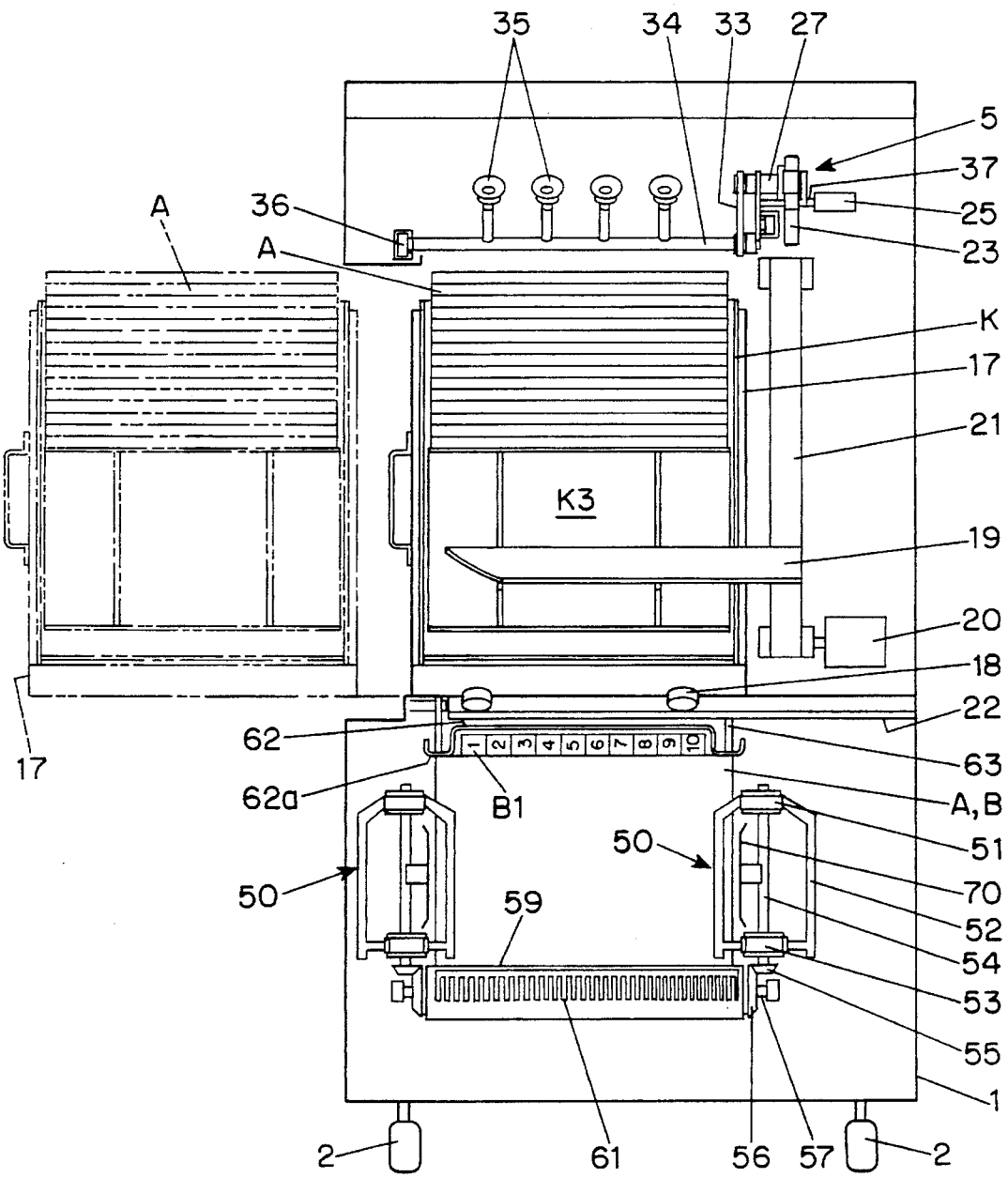
FIG. 2 is a section along the line II—II in FIG. 1.

The sheaf of papers B usually consists of a sheaf of sheets of paper of the same size (A4) which are not interconnected. Further, the sheaf of papers B may contain so called index sheets having portions on which letters and/or numbers are printed, which portions project beyond the other sheets of the sheaf of papers. In FIG. 2 there is shown a sheaf of this kind containing 10 index sheets B1 provided with numerals 1–10. As is evident from the figure, the index sheets B1 are designed such that no portions of the same project beyond the upper side edge of the sheaf of papers B in the two areas adjacent the two end edges of the sheaf of papers.

Each of the covers A consists of a sheet of cardboard and/or plastics material provided with creasing lines along which the sheet is folded and which define two cover sheets and a spine therebetween. On the inside of the spine there is attached a binding agent, usually consisting of a bead of glue of a thermoplastic material, which at room temperature is solid but will become plastic when heated.

A substantial number of covers A are packed in containers or cassettes K intended to be inserted into the machine in a manner shown on the drawings and to be described below. Each cassette K consists of a box of cardboard or the like which is closed during storage and transportation. The cassette is provided with weakenings so that a portion K4 of the cassette is easily removable to expose an opening K1, through which the covers A may be taken out of the cassette. Opposite the opening K1, the cassette K has an abutment K2 which, for example, Is integral with the cassette and which centers the covers therein. The cassette K also contains a support means K3, preferably in the form of a cardboard wedge extending between two of the side walls of the cassette, which cardboard wedge is displaceable within the cassette obliquely upwards-downwards as shown in FIG. 1.

An empty cassette K is filled with covers A by inserting a stack of covers, which bear against each other and form a V-shape, for example, through the base of the cassette, whereupon the wedge K3 is likewise inserted through the base and into the space in the innermost cover. The base is then closed. In the filled cassette K the outermost cover A bears against the abutment K2 and against a non-illustrated cap portion of the cassette, identical with the abutment, which portion will later be removed on opening of the cassette so as to form the opening K1. Said cover in turn bears against another cover such that the binding agent on the spine of the first-mentioned cover is located opposite and in contact with the outside of the spine of the last-mentioned cover or is located at a short distance therefrom. By means of the abutment K1, said portion and the wedge K3 it is ensured that the covers will be centered and that they will keep their V-shape in the cassette.

On the drawings there are shown two parallel-epipedic cassettes K, without caps, inserted beside each other in the machine. More specifically, each cassette is detachably inserted in a slider 16 and 17, respectively, which is easily slidable, by means of wheels 18 and expanding bars 22, from a position shown in dash-dotted lines in FIG. 2 outwardly of the machine support 1 to a position inside the machine as shown in solid lines in FIGS. 1 and 2.

When one of the sliders 16, 17 containing a cassette K is pushed into the machine, a sword 19 disposed in the machine will penetrate one of the side walls of the cassette and will be inserted in the wedge K3 to the position shown in FIG. 2. The sword 19 will then be displaced upwards by a reversible motor 20 which is connected with the sword by means of a belt 21. Said displacement will cause the wedge K3 to be displaced upwards in the cassette carrying with it the covers A while the sword 19 is cutting a slot in the side wall of the cassette. In order to facilitate said cutting, the side wall may, for example, be perforated. The displacement of the sword, the wedge and the covers will continue until the spine portion of the uppermost (outermost) cover A acts on a photocell means (not shown) disposed above the cassette K which will give an impulse to the motor 20 to stop.

Figure 3:
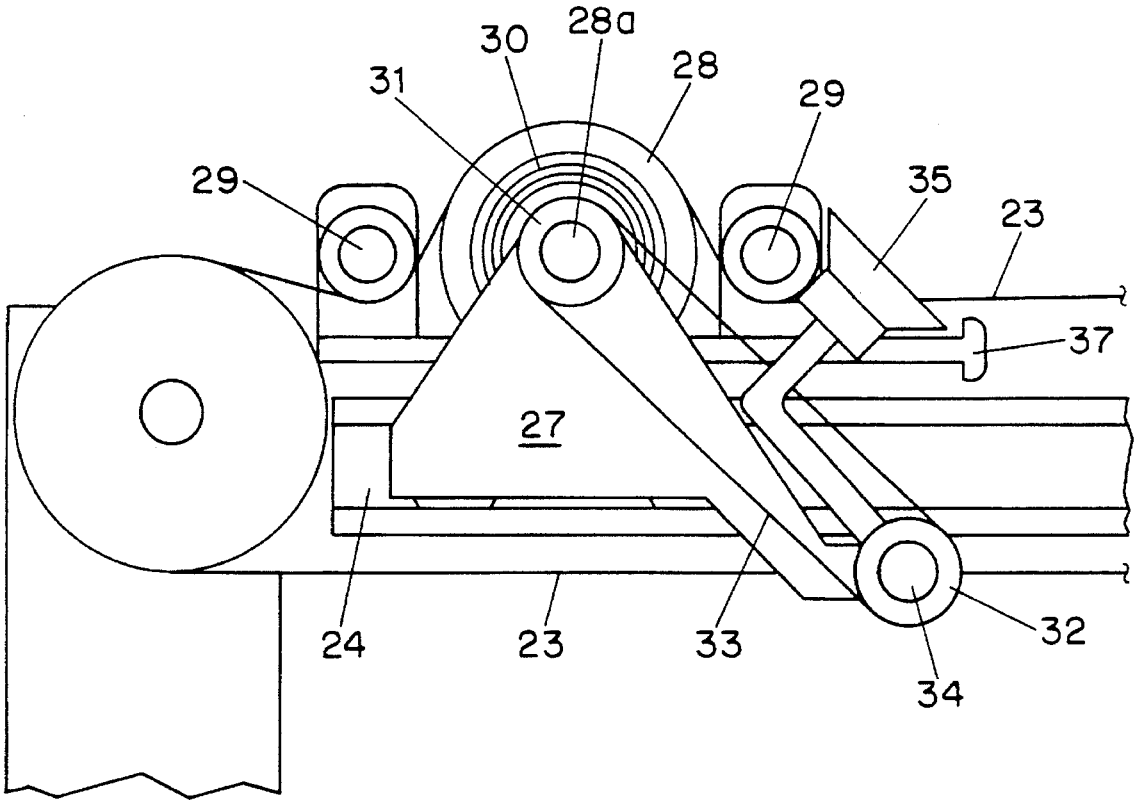
FIG. 3 is a side view showing the device of Figs. 1 and 2 on an enlarged scale.

The device 5, which is best shown in FIG. 3, includes a reciprocating endless conveyor belt 23 driven by a reversible motor (not shown). In the space between the upper and lower parts of the conveyor belt 23 there is a rail 24, a vertically slidable projection 25 and a fixed projection 26. A slider 27 is horizontally slidably mounted on the rail 24. The slider 27 carries a wheel 28. Between the wheel 28 and the shaft 28*a*, on which the wheel is rotatably mounted on the slider, acts a helical spring 30. The belt 23 passes over the wheel 28 and under two rolls 29 rotatably mounted on either side of the wheel in the slider 27. The shaft 28*a* supports a wheel 31. On the slider 27 there is rotatably mounted a long shaft 34. A wheel 32 is attached to the shaft 34. The wheels 31 and 32 are inter- connected by means of an endless belt 33. The shaft 34 which is hollow, supports four hollow arms with suction cups 33. The end of shaft 34 which is not mounted in the slider 27 is rotatably mounted on the machine support 1, at 36. A vacuum source (not shown) is connected with the shaft at 36.

When the belt 23 is moved in such a way that its upper part moves towards the right in FIGS. 1 and 3, the slider 27 will also be moved in this direction. When a damping means 37 attached to the slider strikes the stop 25, the slider will stop moving, but the belt 23 will continue its movement while turning the wheel 28 clockwise and the spring 30 being stretched. During the turning of the wheel 28, the shaft 28*a* will be turned, too. As a result of the turning of the wheel 28 and therefore of the wheel 31, also the wheel 32 will be turned via the belt 33, implying that the shaft 34 and therefore the suction cup 35 will be turned clockwise approximately 180° C. At the end of this movement the suction cups 35 will strike the uppermost cover A in the left-hand cassette K in FIG. 1 and when the desired vacuum has been achieved an impulse will be given to the drive motor of the belt 23 to change the sense of rotation of the belt. During the return motion of the belt 23, the force in the stretched spring 30 will be released such that the shaft 34 will be turned back towards its initial position shown in FIG. 3, and the suction cups 35 will remove the cover A from the cassette K. When the shaft 34 has reached the initial position the slider 27 will start its return motion towards its initial position shown in FIG. 3 and on reaching said position an impulse will be given to said vacuum source to stop the suction in the suction cups 35, whereby the cover will be released and will fall from the position shown in dash dotted lines in FIG. 1 in the direction of the arrow P3.

The stop 25 may be moved from the position in Fig. 1 in order not to prevent the slider 27 from being moved to a position in which it is stopped by the projection 26 above the right-hand cassette K. Said movement takes place on an impulse from the machine or the machine operator when covers A are to collected from the right-hand cassette, which should be done when the left-hand cassette is empty or when covers of other size or kind are to be used instead of the covers in the left-hand cassette.

The assembly device 4 comprises a holder or a gap having two side walls 38 and 39 opposing each other at an angle of approximately 45°. The bottom of the gap 38, 39 is defined by a roll 40 rotatable by a non-illustrated motor and having a shoulder 41 as well as by a counter roll 44 driven by a spring, which counter roll is freely rotatably towards the roll 40. The side walls 38 and 39 are provided with a fixed suction cup 42 and a movable suction cup 43, respectively, which are connected to a vacuum source (not shown).

When the device 5 has delivered a cover 5, said cover will fall partially opened into the device 4. The cover is held in this partially opened condition by the activated suction cups 42 and 43. When the spine of the cover A has been brought to bear against the shoulder 41, the arm 11 will be pivoted in the direction of the arrow P1 and the platform in the direction of the arrow P2, so that the sheaf of papers B will be placed in the cover with one side edge of the same bearing against the inside of the spine, as shown in solid lines in FIG. 1, The holding means 15 will then be acted on such that it will let go of the sheaf of papers B, and the arm 11 and platform 10 will then be returned to their positions shown in solid lines in FIG. 1

The roll 40 will then be rotated counter-clockwise, and the shoulder 41 will get out of contact with the spine of the cover A. The counter roll 44 will then be moved to the right in FIG. 1 and will clamp the cover A containing a sheaf of papers B against the periphery of the roll 40 above the shoulder 41. On continued rotation of the rolls 41, 44, the cover and the sheaf of papers will be fed by said rolls in the direction of the arrow P4 and will fall down into the inclining collecting device 6.

The device 6 comprises a shelf 46 mounted rotatably around the shaft 45, which shelf is able to support one or more covers A containing sheaves of papers B. When the device 6 is pivoted clockwise round the shaft 45 to its vertical position shown in FIG. 1 in dash dotted lines, it will deliver the cover or several covers containing a sheaf (sheaves) of papers to the activation device 7.

The activation device 7 comprises a transport device consisting of two identical, synchronously driven conveyors 50 each consisting of two identical cogged belts 51, which are interconnected by means of yokes 52. The smallest distance between the yokes of the two conveyors 50 is less than the height of a cover A. The two belts 51 in each conveyor 50 are driven by identical cogged wheels 53 which are interconnected by means of shafts 54. The lower ends of the shafts 54 are provided with bevel gear wheels 55 engaging bevel gear wheels 56 attached to a shaft 57, one of which being rotated by a motor (not shown). Each of the shafts 57 is provided with a roller 58. Round the rollers 58 extends an endless belt 59 whose speed is synchronous with the speeds of the conveyors 50. Between the two parts of the belts 59 there are disposed a heating means 60 and a cooling means 61.

On moving the transport device towards the right in FIG. 1, a cover A or several covers A containing a sheaf (sheaves) of papers B, which are inserted by the device 6 between the conveyors 50, are collected by the yokes 52 and the belt 59. In FIG. 2 there is shown a cover A containing a sheaf of papers B resting on the belt 59 and located between two pairs of opposing yokes 52. The distance between two adjacent yokes 52 in each conveyor 50 is selected such that there is room between them for several covers A of small spine width and containing sheaves of papers B or such that there is room between them for one cover of the largest spine width and containing a sheaf of papers.

During the transportation of the covers A containing sheaves of papers B through the device 7, the thermoplastic beads of glue on the inside of the spines are first heated by the device 60 so that the beads of glue will melt and the sheaves of papers will sink into the same. When this has been done and the covers are being moved further, the bead of glue will be cooled by the device 61, whereby the beads of glue will solidify and the sheaves of papers B will be connected to the inside of the spines. During the transportation of the covers A containing the sheaves of papers B through the heating portion of the device 7, i.e. over the device 60, they will be jogged up by the device 8.

The jogging up device 8 comprises a plate 62 having two lower side portions 62*a* , the distance between which is somewhat less than the height of a cover A and a sheaf of papers B and is somewhat greater than the portions of the index sheets B1 projecting beyond the edge of the sheaf of papers and the cover farthest away from the latter. The plate 62 is connected with two arms 63 mounted on the machine support 1 and is pivoted by a motor (not shown) between an upper position at a distance from the the covers and the sheaves of papers in the device 7 and a lower position in which the portions 62*a* press against the two areas of the covers and the sheaves of papers which are located on either side of the index sheets B1. The last-mentioned position is shown in FIGS. 1 and 2. The extension of the plate 62 in the longitudinal direction of the device 7 is greater than the distance between a plurality of yokes 52 in order for several covers and sheaves of papers to be jogged up simultaneously every time the plate 62 is pivoted towards the same.

A second jogging-up device comprises two spaced apart plates 70 to which is imparted, by non-illustrated drive means, a repeated movement towards and from the vertical side edges of the covers A and the sheaves of papers B in FIG. 2 so as to ensure that they will be positioned in a respective vertical plane.

On leaving the device 7, the finished booklets H will be taken care of by the transport device 9.

The transport device 9 comprises two spaced apart endless conveyor helms 64 extending around two rollers 65 and 66, one of which is driven by a motor (not shown). The belts 64 are provided with a plurality of projecting, equally spaced apart shelves 67. When, on leaving the belt 59 and the yokes 52, one or more finished booklets H are located in the travel path of a shelf 67, which is driven synchronously with the belt 59 and the yokes 52, said booklet or booklets will be caught by the shelf and will be transported upwards until the shelf is right opposite the roller 66 when a motor driven device 68 working synchronously with the belt 64 will convey the booklet(s) to an inclined plane 69 on the machine support. In said plane 69, the booklets are available to be removed from the machine.

While only one embodiment of the present invention has been described above and shown on the drawings, it will be understood that the invention is not restricted to said embodiment but only by what is stated in the claims.

We claim:

1. A method for manufacturing booklets, the booklets including a cover made up of two cover sheets, a spine therebetween, a bead of glue attached to the inside of the spine, and a sheaf of papers inserted between the two cover sheets, one side edge of the sheaf being connected to the inside of the spine by means of the bead of glue, comprising the steps of:

moving a sheaf of papers by a power operated transport means from sheaf receiving means to an assembly means Without disassembling the sheaf of papers, moving one of a supply of covers by the transport means from cover dispensing means to the assembly means at a distance away from the supply of covers, bringing the sheaf of papers by the transport means into contact with the cover, whereby a side edge of the sheaf of papers contacts the bead of glue, moving the cover containing the sheaf of papers and an activation device relative to each other, activating the bead of glue to connect the side edge of the sheaf of papers to the inside of the spine.

2. A method according to claim 1, further comprising the step of feeding the sheaf of papers from a photocopying or printing device distant from said transport means to said sheaf receiving means, for movement by said transport means to said assembly means.

3. A method according to claim 1, wherein the activating step compromises the steps of heating to partially melt the bead of glue, and cooling to solidify the bead of glue.

4. A method according to claim 1, further comprising the step of spacing the cover sheets apart from each other when the cover is in the assembly means, moving the cover sheets toward each other after the sheaf of papers is brought into contact with the cover, whereby the cover sheets are essentially parallel, and maintaining the cover sheets in the parallel position when the cover and sheaf are moved through the activation device.

5. A method according to claim 1, further comprising the step of moving the cover containing the sheaf of paper to a holding position before being moved through the activation device.

6. A method according to claim 1, further comprising the step of jogging up the sheaf of papers after the sheaf of papers is brought into contact with the cover.

7. A method according to claim 1, further comprising the step of storing each of the supply of covers in said cover dispensing means in movable relation to each other and at essentially equal distances from each other and wherein said cover dispensing means comprises a cassette having an openinig by wich the transporting means can acces an outermost cover of the supply of covers.

8. A method according to claim 7, further comprising the step of moving the remainder of the supply of covers toward the opening of the cassette after the outermost cover is moved by the transport means to the assembly means.

9. A method according to claim 8, wherein the supply of covers is moved by transfer means.

10. A method according to claim 9, wherein the transfer means includes means for supporting the covers.

11. A method according to claim 1, wherein the step of moving one of the supply of covers is performed by a second power operated transport means.

12. A method according to claim 1, wherein the activation device is moved along the cover containing the sheaf of papers.

13. An apparatus for manufacturing booklets, the booklets including a cover made up of two cover sheets, a spine therebetween, a bead of glue attached to the inside of the spine, and a sheaf of papers inserted between the two cover sheets, one side edge of the sheaf being connected to the inside of the spine by means of the bead of glue, comprising:

first power operated transport means for moving a sheaf of papers from sheaf receiving means to a first position without disassembling the sheaf of papers, second power operated transport means for moving a cover from a supply of covers contained in a cover dispensing means to a second position distant from the supply, assembly means for bringing the sheaf of papers together with the cover so that a side edge of the sheaf of papers contacts the bead of glue, third transport means for receiving the assembled cover and sheaf of papers, and activation means movable relative to the third transport means for activating the bead of glue and causing the sheaf of papers to connect to the cover.

14. An apparatus according to claim 13, wherein the activation means includes heating means and cooling means, the cooling means positioned downstream of the heating means relative to the direction of movement of the activation means.

15. An apparatus according to claim 13, wherein the second power operated transport means includes reciprocating suction means.

16. An apparatus according to claim 13, wherein the assembly means includes a holder for holding the cover sheets open to receive the sheaf of papers, and further comprising fourth transport means for transporting the assembled cover and sheaf from the holder to third transport means.

17. An apparatus according to claim 13, further comprising movable collecting means for collecting a plurality of assembled covers and sheaves and transporting them to the third transport means.

18. An apparatus according to claim 13, further comprising jogging up means for jogging up the sheaf of papers after it is brought together with the cover by the assembly means.

19. An apparatus according to claim 13, wherein said cover dispensing means comprises a cassette for storing a supply of covers and defining an opening by which one of the supply of covers can be removed from the cassette by the second transport means, and transfer means for shifting the supply of covers toward the opening after the one cover is removed.

20. An apparatus according to claim 19, wherein the transfer means contacts at least one of the supply of covers.

21. An apparatus according to claim 19, wherein the transfer means extends into the cassette by way of an opening defined in a wall of the cassette.

22. An apparatus according to claim 19, wherein the transfer means is located at a distance from the supply of covers, and the cassette includes support means for connecting the transfer means to the supply of covers.

23. An apparatus according to claim 13, wherein the third transport means is movable relative to the activation means.

24. An apparatus according to claim 23, wherein the activation means includes heating means and cooling means, the cooling means positioned downstream of the heating means relative to the direction of the movement of the third transport means.

25. A cassette for use in an apparatus for manufacturing booklets, the booklets including a cover made up of two cover sheets and a spine therebetween, and a sheaf of papers inserted between the cover sheets, a side edge of the sheaf of papers connected to the inside of the spine by a binding agent, the apparatus including transport means for assembling a cover with a sheaf of papers and activation means for activating the binding agent, comprising:

a supply of covers arranged so that the inside of the spine of each cover is positioned opposite the outside of the spine of an adjacent cover, a first opening defined in the cassette through which the supply of cover can be removed from the cassette, and support means for supporting the supply of covers in a predetermined position within the cassette.

26. A cassette according to claim 25, wherein the cassette is adapted to be detachable inserted in the manufacturing apparatus in interactive relation with the transport means for removing one of the supply of covers from the cassette.

27. A cassette according to claim 25, wherein the covers are stored in a V-shaped array.

28. A cassette according to claim 25, wherein a second opening is defined therein to receive an external actuation means for moving the supply of covers within the cassette.

29. A cassette according to claim 28, further comprising a removable cap for defining the first opening, and a wall for defining the second opening, wherein the external actuation means forms the second opening by puncturing the wall, and the external actuation means acts upon the support means for moving the supply of covers.

30. A cassette according to claim 25, wherein the support means is a wedge which contacts the cover positioned furthest from the first opening, and is adapted to be acted upon to move the supply of covers.

31. A cassette according to claim 25, further comprising an abutment adjacent the first opening for positioning the supply of covers within the cassette.

32. A method for filling a cassette with a supply of covers, the cassette having means for supporting the covers therein, and each cover including two cover sheets and a spine therebetween and which, upon opening of the cassette, is removable from the cassette for receiving a sheaf of papers to form a booklet, comprising the steps of:

stacking the supply of covers in a V-shaped array, and placing the stack of covers on the support means so that a cover located at an end of the stack is in contact with the support means.

33. A method according to claim 32, further comprising the step of moving the support means within the cassette for dispensing the covers.

34. A method for assembling and jogging up a sheaf of papers before or during the binding thereof into a cover to form a booklet by way of a binding agent connected to an inside spine of the cover, the sheaf of papers including at least one index sheet having a projection extending from the side edge of the sheaf parallel to and farthest from the spine of the cover, comprising the steps of:

moving a sheaf of paper by a power operated transport means from sheaf receiving means to an assembly means without disassembling the sheaf of papers, moving one of a supply of covers by the transport means from cover dispensing means to the assembly means at a distance away from the supply of covers, bringing the sheaf of papers by the transport means, into contact with the cover, whereby a side edge of the sheaf of papers contacts the binding agent, pressing the side edge of the sheaf parallel to and farthest from the spine of the cover at two spaced apart locations which do not have an index sheet projection, and which are closest to the edges of the sheaf of papers perpendicular to the side edge, and jogging up the sheaf of papers whereby the outer edges of the cover sheets are essentially level with the side edge of the sheaf of papers farthest from the spine, and essentially level with the side edge of the portion of the index sheet on which there is no projection.

35. An apparatus for assembling and jogging up a sheaf of papers before or during the binding thereof into a cover to form a booklet, wherein the sheaf of papers comprises a plurality of index sheets included within the sheaf of papers and having projections extending from the side edge of the sheaf parallel to and farthest from the spine of the cover, and wherein the cover includes a spine with a binding agent thereon, comprising:

power operated transport means for moving a sheaf of papers from sheaf receiving means to a first position without disassembling the sheaf of papers and for moving a cover from a supply of covers contained in a cover dispensing means to a second position distant from the supply of covers, assembly means for bringing the sheaf of papers together with the cover so that a side edge of the sheaf of papers contacts the binding agent, pressing means arranged to press against a plurality of spaced apart areas on the side edge of the sheaf parallel to and farthest from the spine and having no index projections, wherein the distance between the pressing means corresponds to the length of the spine.

36. An apparatus according to claim 35, wherein the pressing means includes a plurality of spaced apart pressing surfaces arranged to oppose the plurality of spaced apart areas and to press the spaced apart areas at positions near the edge of the sheaf of papers perpendicular to the side edge.

* * * * *